US006796262B2

(12) United States Patent
Moses

(10) Patent No.: US 6,796,262 B2
(45) Date of Patent: Sep. 28, 2004

(54) STRUCTURAL FLOTATION DEVICE

(76) Inventor: William E. Moses, PMB293, 370 NE. Camano Dr., Suite 5, Camano Is., WA (US) 98282

( * ) Notice: Subject to any disclaimer, the term of this patent is extended or adjusted under 35 U.S.C. 154(b) by 0 days.

(21) Appl. No.: 10/376,398

(22) Filed: Feb. 28, 2003

(65) Prior Publication Data

US 2004/0168624 A1 Sep. 2, 2004

(51) Int. Cl.[7] ..... B63B 35/44
(52) U.S. Cl. ..... 114/263; 114/267
(58) Field of Search ..... 114/263, 267, 114/61.1

(56) References Cited

U.S. PATENT DOCUMENTS 2,984,076 A * 5/1961 Bradley ..... 405/219
4,834,014 A 5/1989 Olsen et al.
5,062,817 A * 11/1991 Wearne ..... 441/45
5,235,929 A * 8/1993 Chester et al. ..... 114/266
5,658,178 A * 8/1997 Varga ..... 441/1
5,931,113 A * 8/1999 Eva et al. ..... 114/263
6,089,176 A 7/2000 Costello

* cited by examiner

*Primary Examiner*—Stephen Avila
(74) *Attorney, Agent, or Firm*—Charles J. Rupnick

(57) ABSTRACT

A structural flotation device formed of two elongated shear panels embodied as substantially planar sheets of high-density polyethylene (HDPE) that are spaced apart by two or more substantially parallel and spaced apart heavy-gauge HDPE buoyancy tubes. The buoyancy tubes are transversely oriented relative to the elongated shear panels. All of the buoyancy tubes are of a substantially identical length that is foreshortened relative to the elongated shear panels. The openings in both ends of each buoyancy tube are joined to a substantially planar and unbroken surface of each of the elongated shear panels with substantially water-tight structural seams along its entire circumference.

22 Claims, 4 Drawing Sheets

STRUCTURAL FLOTATION DEVICE

FIELD OF THE INVENTION

The present invention relates to the field of flotation devices, and in particular to flotation devices formed of interconnected tubing or pipe and methods of forming the same.

BACKGROUND OF THE INVENTION

Many prior art float systems exist which use flotation devices formed from one of a variety of conventional materials such as Styrofoam, polyethylene tubs, concrete sections poured around Styrofoam cores and others. Large concrete floats are known in which concrete forms the structural component and the flotation device is enclosed Styrofoam or air.

Flotation devices using interconnected tubing or pipe for buoyancy and methods of forming the same are also generally well-known. U.S. Pat. No. 4,834,014, entitled FLOATING PLATFORM STRUCTURE, issued May 30, 1989, to Olsen, et al., for example, describes a semi-submersible floating platform structure supported by a number of buoyancy bodies in the form of pipes closed at the ends by welded plates. The closed pipes rest in recesses in a plurality of inverted cribs or yokes that also act as buoyancy bodies. A deck structure is mounted on top of columns projected above the buoyancy bodies to form the float structure.

U.S. Pat. No. 6,089,176, entitled APPARATUS FOR AND A METHOD OF CONSTRUCTING A FLOATING DOCK STRUCTURE, issued Jul. 18, 2000, to Costello describes a floating dock structure formed of two sets of parallel and space apart heavy-gauge, high-density polyethylene (HDPE) tubes interconnected and scaled water-tight by a plastic joining process to form a square or rectangular configuration of pontoon floats. An overlying series of deck crosspieces completes the floating dock structure.

Other prior art devices are also known using elongated buoyancy,tubes or pipes with an overlying decking. Such devices as are known in prior art generally connect the elongated buoyancy tubes or pipes transversely between spaced apart generally planar walls.

While useful in some applications, all these prior art devices are generally limited as structural supports.

SUMMARY OF THE INVENTION

The present invention provides a structural flotation device and method for producing the same. The structural flotation device of the invention is formed of two elongated shear panels embodied as substantially planar sheets of high-density polyethylene (HDPE) that are spaced apart by two or more substantially parallel and spaced apart heavy-gauge HDPE buoyancy tubes that are transversely oriented relative to the elongated shear panels. All of the buoyancy tubes are of a substantially identical length that is shorter than the elongated shear panels. The openings in both ends of each buoyancy tube are joined to a substantially planar and unbroken surface of each of the elongated shear panels with substantially water-tight structural seams along its entire circumference. The durable HDPE material-based structural flotation device of this invention experiences no electrolysis, requires no painting, and is impervious to destructive marine borers.

Any concrete, wood or other deck can be installed on the top of the floating structure.

This invention is a type of floating structure to be used as a basis for a floating marina or the foundation for any type of floating structure. The flotation units of the structural flotation device of the invention are sections of high-density polyethylene pipe which form the float of any length, but according to one aspect of the invention, the in lengths between about 4 and 12 feet. When the shear panels are straight to form a substantially rectangular floating structure, as shown in the Figures, the ends of the transverse pipe sections are cut square and thermally fused to a pair of shear panels formed by high-density polyethylene (HDPE) sheet material which is slightly wider than the pipe diameter and as long as the entire structural flotation device, which may be any length, but according to one aspect of the invention is about 20 to 40 feet in length. The pipe sections are spaced apart as a function of flotation and structural requirements of the intended application.

According to another aspect of the invention, the floating structure may be curved, as in a round or annular "donut" shape, or angled in another non-rectangular configuration. When the shear panels are curved to form a substantially curved floating structure or angled to form a non-rectangular structure, the ends of the transverse pipe sections are contoured to match the curvature or angularity of the shear panels.

Both the HDPE pipe and HDPE sheet are manufactured products that are commercially available. The currently manufactured sheet are heat fused to form sheet in longer lengths preferred for this invention. Longer lengths may become commercially available in time.

The effectiveness of the flotation system of the invention is the shear strength of the sheet of which the shear panels are formed. When the pipe sections of the buoyancy tubes are connected to the continuous sheet of the shear panels, which span the entire length of the flotation device, the large moment of inertia of the planar sheet results in a flotation device strong enough to operate as a structural device. The rigid connection of the tube sections to the sheet product flotation device maintain the planar orientation of the shear panels to the loaded deck surface such that a rigid structural component results upon which even buildings can be erected. The tube sections range in diameter from between about 14 inches to as much as 48 inches or more, the diameter selected being a function of the amount of flotation required for the application and the expected wave environment.

The effectiveness of the polyethylene sheet welded to the pipe sections also results in the structural flotation device being unusually strong relative to its weight. As a result the structural flotation device of the invention is easier to ship and handle than flotation devices of the prior art and also make very effective sectional barges or floating platforms.

According to another aspect of the invention, the structural flotation device of the invention is alternatively embodied having multiple rows of the transverse HDPE tubes. The vertical depth of the shear panels is increased by use of wider sheets of the HDPE material, thereby making room for the additional rows of transverse tubes. The rows of transverse tubes are either vertically aligned or laterally offset. According to another aspect of the invention, an upper row of the transverse tubes are sealed to create the buoyancy tubes that provide flotation, while one or more of the transverse tubes of the deeper rows are filled with a ballast material to create passive ballast tubes. The passive ballast tubes push the center of gravity of the flotation device lower in the water to provide stability in rough sea conditions.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

The present invention is a structural flotation device and method for producing the same. The structural flotation device of the invention includes two elongated shear panels formed of substantially planar sheets of high-density polyethylene (HDPE) spaced apart; by two or more substantially parallel and spaced apart heavy-gauge HDPE buoyancy tubes transversely oriented relative to the elongated shear panels, all of the buoyancy tubes being of substantially identical length foreshortened relative to the elongated shear panels, and both ends of each buoyancy tube being joined with substantially water-tight structural seams along its entire circumference to a substantially planar and unbroken surface of each of the elongated shear panels.

Use of a plastic joining process, such as thermal fusion, integrally joins the planar sheets of HDPE material with the transverse HDPE buoyancy tubes to form a single monolithic structural flotation device. The durable HDPE material-based structural flotation device of this invention experiences no electrolysis, requires no painting, and is impervious to destructive marine borers.

Figure 1:
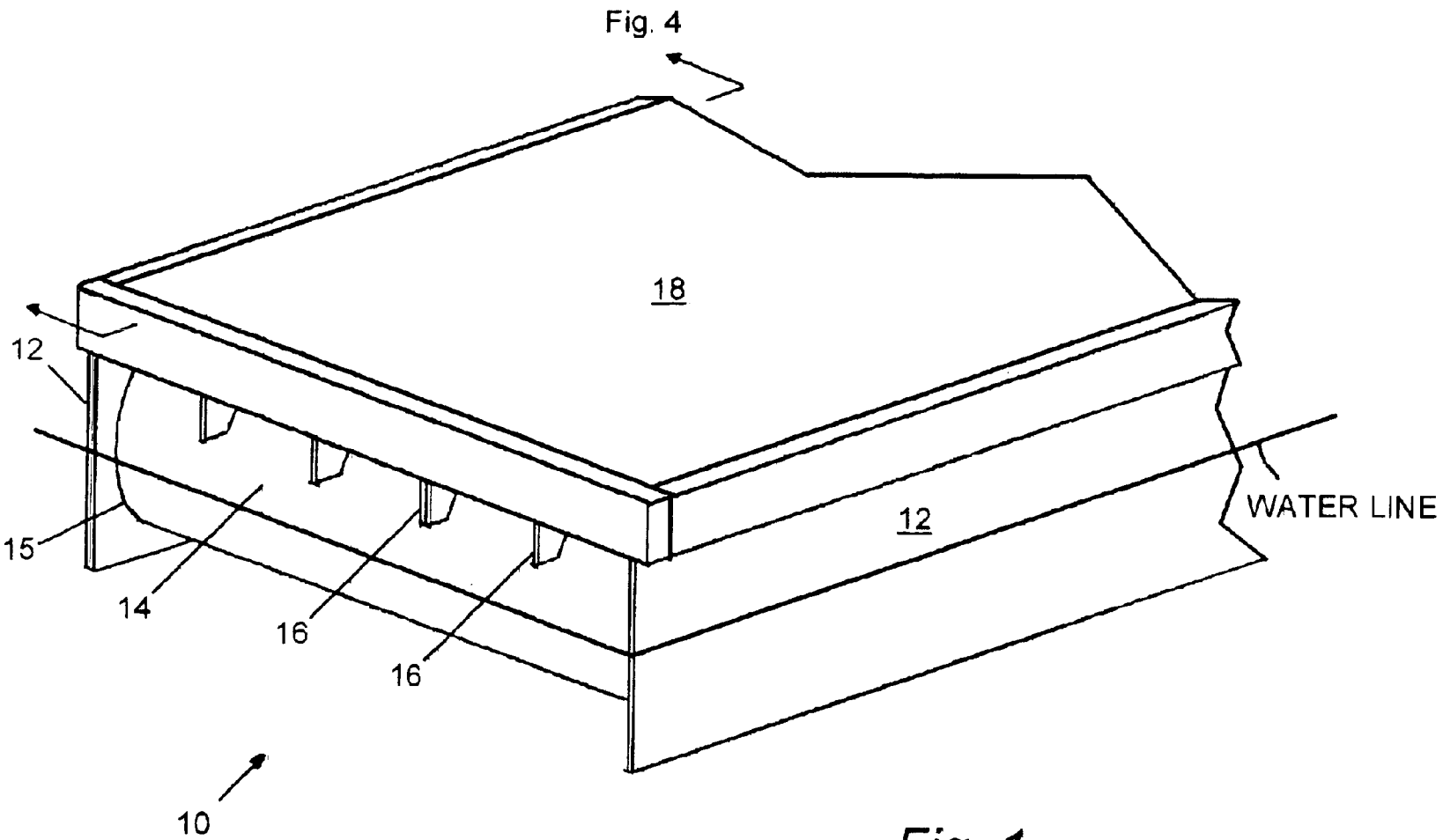
FIG. 1 is a pictorial view of a portion of a floating structure integrating the structural flotation device of the invention embodied as a pair of elongated shear panels spaced apart across the width of the structural flotation device.

FIG. 1 is a pictorial view of a portion of a floating structure integrating the structural flotation device 10 of the invention embodied as a pair of elongated shear panels 12 of about 20 foot to 40 foot lengths spaced apart across the width of the structural flotation device 10. As illustrated, the spaced apart elongated shear panels 12 are substantially parallel and oriented vertically relative to the water line when the structural device 10 is floated. The elongated shear panels 12 are embodied as substantially planar sheets in the range of about ¾ inch or thicker high-density polyethylene (HDPE) spaced apart by two, three or more buoyancy tubes 14 (one shown). The buoyancy tubes 14 are embodied by example and without limitation as substantially identical about 4 foot to 12 foot lengths of hollow SDR 32.5 HDPE tubes about 18 inch to 24 inch diameter. The buoyancy tubes 14 are alternatively embodied in tubes that are shorter or longer than the 4 to 12 foot range and may be of smaller or larger diameter than the 18inch to 24 inch range.

Spacing between adjacent buoyancy tubes 14 is selected as a function of the expected load and structural requirements of the resulting structural flotation device 10. The thickness or gauge of the tube sections 14 and of the shear panels 12 are selected as a function of requirements required for a specific application as determined by structural calculations. Both the HDPE pipe for making the tubes 14 and the HDPE sheet for making the shear panels 12 are commercially available manufactured products. As currently manufactured, the HDPE sheets are heat fused to form sheet of the lengths desired for the shear panels 12 of this invention. Longer lengths of HDPE sheet material may become commercially available in time.

Each of the buoyancy tubes 14 is cut crosswise to its length so that it is significantly shorter than the elongated shear panels with all of the buoyancy tubes 14 being substantially the same length. The buoyancy tubes 14 are oriented transversely to the vertically oriented shear panels 12 and spaced along their lengths. The transverse buoyancy tubes 14 are joined to the elongated shear panels 12 either through a thermal fusion process or a mechanical joining process capable of achieving a desired rigid structural joint 15 having a water-tight seal. The combination of the elongated shear panels 12 with the transversely oriented buoyancy tubes 14 forms the monolithic foundation of the floating structure 10 which is a dock or another floating product.

The effectiveness of the monolithic structural flotation device 10 of the invention is the shear strength of the HDPE sheet 12 rigidly welded or otherwise rigidly joined to the ends of the tube sections 14. With the tube sections 14 structurally joined to the continuous shear panels 12, each one spanning the entire length of the monolithic structural flotation device 10 of the invention, the shear strength inherent in the planar dimension of the HDPE sheet results in an extremely large moment of inertia that resists crosswise distortion or bending, while the relatively short and large diameter tubes 14 result in a large moment of inertia resists distortion or bending about the longitudinal axis of the structure 10. The flotation device 10 thus forms an extremely rigid structural component.

According to one embodiment of the invention, the rigid structural joints 15 are produced by a conventional thermal fusion plastic welding process that joins the open ends of the HDPE pipe forming the buoyancy tubes 14 to the sheet of HDPE material of which the shear panels 12 are formed. The thermal fusion welding process is known to join the distinct buoyancy tubes 14 with the shear panels 12 in a single integral unit that produces the monolithic structural flotation device 10 of the invention.

Alternatively, the rigid structural joints 15 are produced by another conventional mechanical joining method, such as is generally well-known in the art. For example, the rigid structural joints 15 are produced by adhesive, or by bolts through a flange joined to the open ends of the buoyancy tubes 14 and corresponding holes in the shear panels 12. The rigid structural joints 15 are made water-tight by compressible o-rings or another suitable gasket captured between the flanges and the shear panels and being compressed by nuts threaded onto the bolts.

Optionally, multiple interior partial panels 16 of the HDPE material are thermally fused or otherwise structurally joined to an upper surface of each of the buoyancy tubes 14, which provide interior partitions and supports for various types and styles of decking 18. For example, a concrete, wood or other deck 18 can be installed on the top of the floating structure 10, using the shear panels 12 and interior partial panels 16 for support.

Figure 2:
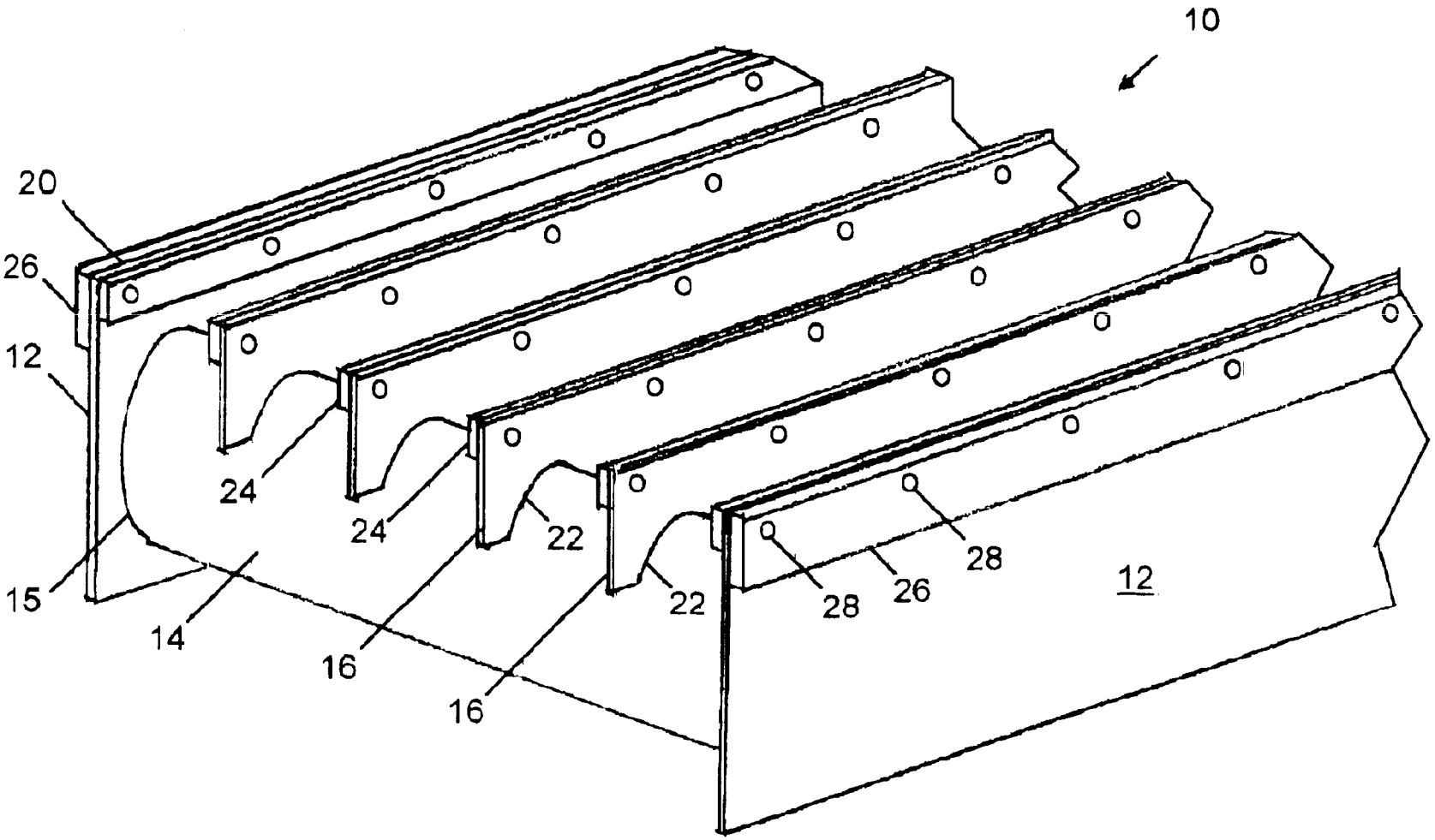
FIG. 2 is a pictorial view of a portion of the monolithic structural flotation device of the invention.

FIG. 2 is a pictorial view of a portion of the monolithic structural flotation device 10 of the invention. The deck 18 is removed from the floating structure shown in FIG. 1 to more clearly show the configuration structural flotation device 10. The buoyancy tubes 14 are spaced far enough from the plane defined by longitudinal top edges 20 of the vertical shear panels 12 to permit interior partial panels 16 to be fit under the deck 18. Each of the interior partial panels 16 is an elongated sheet of the HDPE material similar to the shear panels 12, but is only a fraction of the width or vertical dimension. The interior partial panels 16 are contoured or "coped" to conform to the outer shape of the buoyancy tubes 14. A rigid structural joint 22 is formed between the HDPE material of the buoyancy tubes 14 and the partial panels 16 by a conventional thermal fusion plastic welding process.

Although shown as being substantially parallel and evenly spaced between the vertical shear panels 12, the interior partial panels 16 are optionally oriented diagonally to the shear panels 12 in an "X" configuration. Thus embodied, the interior partial panels 16 operate as cross-bracing that provides shear strength crosswise to the vertical shear panels 12, as will be understood by those of skill in the mechanical arts.

Elongated stringers 24 are secured along the top edge of each interior partial panels 16 and along the interior top edge 20 of each of the shear panels 12 for attachment of the deck 18. According to different embodiments of the invention, the stringers 24 are by example and without limitation any 8 foot, 10 foot, or 12 foot or longer lengths of either 2 inch by 4 inch or 2 inch by 6 inch cross-section of wood, for example, treated fir of number 2 grade or better. The stringers 24 may be cut to shorter lengths as required. Decking 18 is fastened to the interior partitions by way of the stringers using conventional fasteners such as screws or nails (not shown).

Elongated whalers 26 are secured along the exterior top edge 20 of each of the shear panels 12 opposite the corresponding stringer 24. According to one embodiment of the invention, the whalers 26 are any 8 foot, 10 foot, or 12 foot or longer lengths of 3 inch by 8 inch or larger sections of wood, for example, treated fir of number 2 grade or better. Fasteners 28 such as bolts and nuts or another fastening means may be used to secure the stringers 24 and whalers 26 to the respective interior partial panels 16 and exterior shear panels 12.

Figure 3:
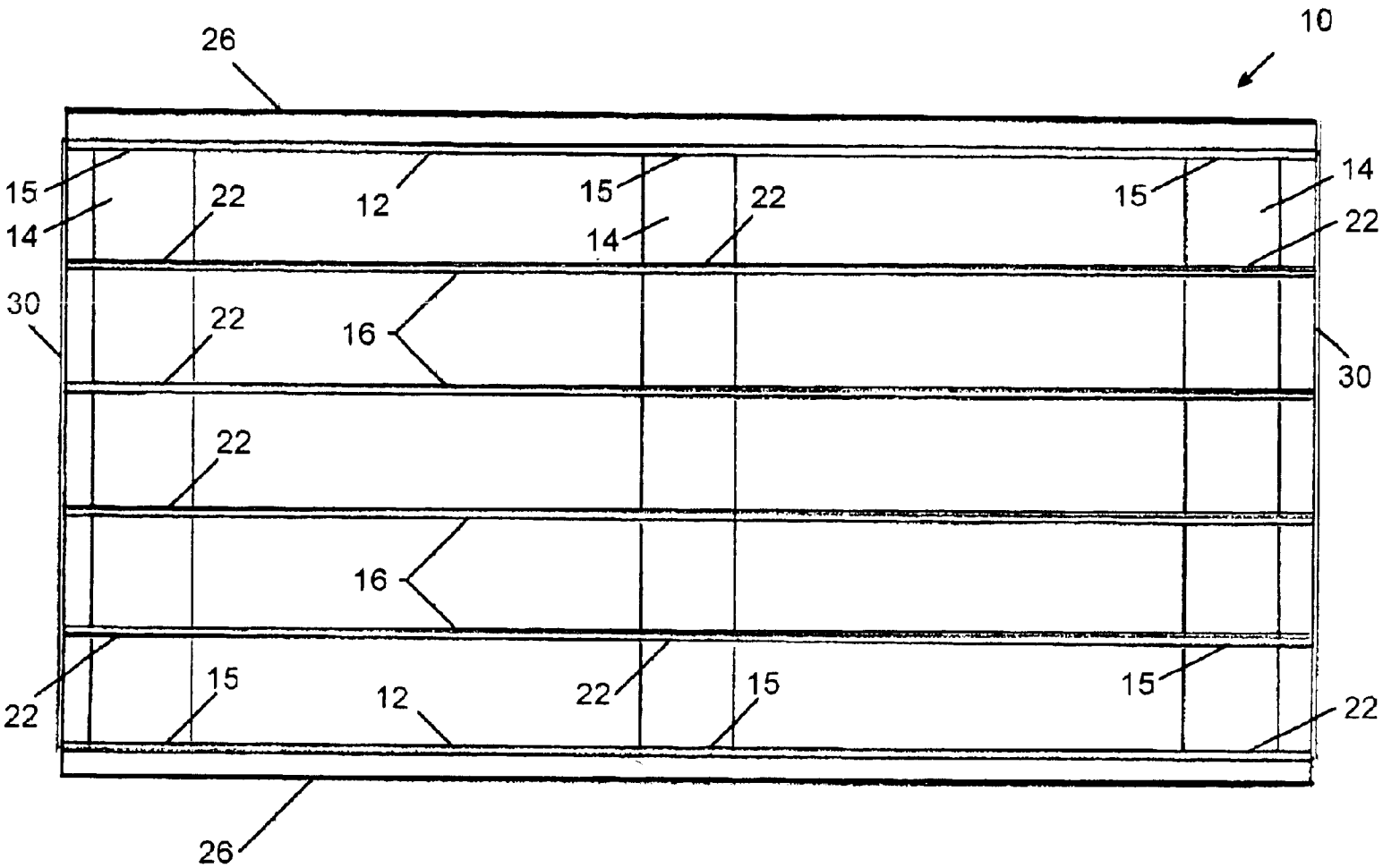
FIG. 3 is a top-down view of the structural flotation device of the invention.

FIG. 3 is a top-down view of the floating structure with the decking 18 removed to show the interior details of the structural flotation device 10, the stringers 24 are removed for clarity. As illustrated, multiple buoyancy tubes 14 are spaced transversely at intervals along the elongated shear panels 12 and rigidly coupled thereto by water-tight structural joints 15. Structural joints 22 are used to rigidly couple the elongated interior panels 16 at intervals along the transverse buoyancy tubes 14 between the external shear panels 12. Additional vertical splash panels 30 of the HDPE material are optionally coupled transverse to the external shear panels 12 and the interior panels 16 by thermal fusing or another suitable method.

Figure 4:
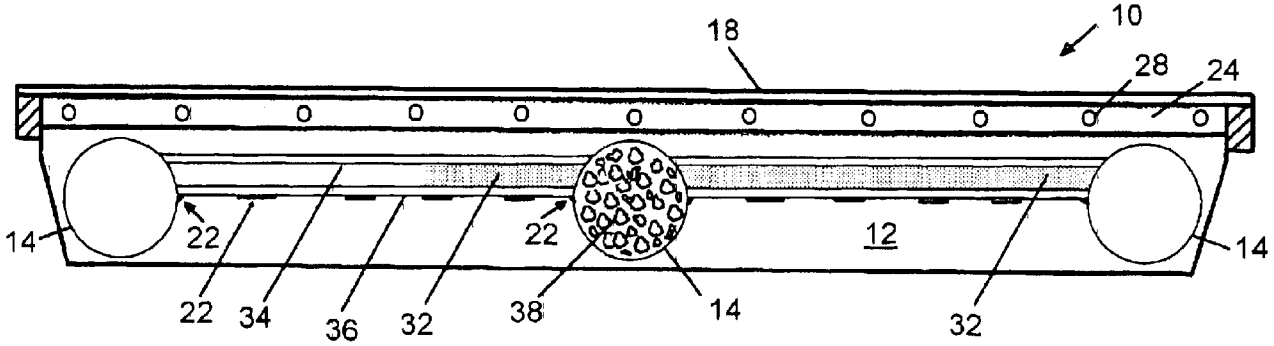
FIG. 4 is a cross-sectional view taken through the floating structure shown in FIG. 1 and showing the structural flotation device 10 of the invention.

FIG. 4 is a cross-sectional view taken through the floating structure shown in FIG. 1. As shown, the structural flotation device 10 of the invention includes three of the transverse buoyancy tubes 14 joined to the elongated shear panels 12. According to one embodiment of the invention, supplemental flotation 32 is provided. By example and without limitation, the supplemental flotation is embodied as Styrofoam in sheet form under the decking 18. The additional buoyancy is a function of the volume of the Styrofoam 32 provided, including the sheet area and thickness of the sheets. According to one embodiment of the invention, crosswise baffles 34 are suspended under the decking 18 between sequential transverse buoyancy tubes 14. The baffles 34 may be wooden in the form of minimum ½ inch treated plywood sheets secured to the transverse buoyancy tubes 14 and the interior wall of the shear panels 12. When the baffles 34 are formed of the HDPE material, they are structurally joined, as by thermal fusing, to both the transverse buoyancy tubes 14 and the shear panels 12. Optionally, the structural joints 22 between the baffles 34 and each of the buoyancy tubes 14 and shear panels 12 are embodied as intermittent or "skip" welds, which enhance manufacturability while ensuring the structural integrity and monolithic characteristic of the floating structure 10. The Styrofoam 32 is joined to the under side of the baffles 34. When the Styrofoam 32 is coated, no additional protection is needed. However, when the Styrofoam 32 is uncoated, a lower splash plate 36 is provided as a protective cover over the Styrofoam. When the splash plates 36 are formed of the HDPE material, they are also structurally joined, as by thermal fusing, to both the transverse buoyancy tubes 14 and the shear panels 12 using rigid structural joints 22 embodied as intermittent "skip" welds. The wood baffles 34 and Styrofoam covers 36 also add cross-axis shear strength to the structural flotation device 10.

When the interior partial panels 16 of HDPE material are presents in combination with the baffles 34 of HDPE material, the two are optionally mutually thermally fused using, for example, the intermittent "skip" welds described above. The thermally fused combination of interior partial panels 16 and crosswise baffles 34 provide a very large moment of inertia acting crosswise to the moment of inertia provided by the elongated shear panels 12.

According to one embodiment of the invention, Styrofoam cores 38 are provided for one or more of the buoyancy tubes 14. The Styrofoam cores 38 provide additional protection from water intrusion and ensure continued buoyancy even if the tough HDPE material is breached.

Figure 5:
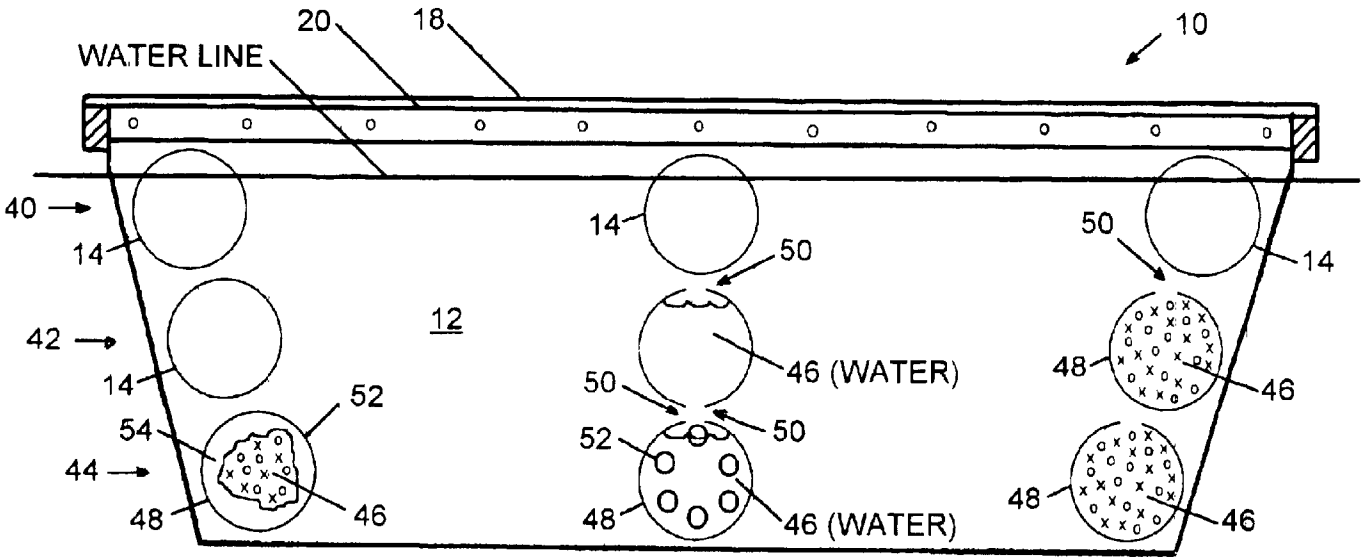
FIG. 5 illustrates the structural flotation device of the invention embodied having shear panels of increased vertical depth and additional rows of transverse buoyancy tubes.

FIG. 5 illustrates the structural flotation device 10 of the invention embodied having multiple rows of the transverse HDPE tubes. The vertical depth of the shear panels 12 is increased by use of wider sheets of the HDPE material, thereby making room for attachment of the additional rows of transverse tubes 14. The rows of transverse tubes 14 may be mutually vertically aligned (shown at center) or laterally offset (shown at right and left). Furthermore, the buoyancy tubes 14 and ballast tubes 48, while being shown in row and column arrangement, are alternatively arranged randomly relative to the shear panels 50.

According to one embodiment of the invention, an upper row 40, of the transverse tubes 14 are sealed to create the buoyancy tubes 14 that provide flotation, while one or more of the transverse tubes 14 of lower or deeper rows 42, 44 are filled with a ballast material 46, such as but not limited to concrete, grout or water, to create passive ballast tubes 48. For example, the passive ballast material 46 is introduced into the transverse tubes 14 through small passages 50 formed in the tube wall. When two or more of the small passages 50 are used, one can operate as a vent while the ballast material is being introduced. Afterward, the small passages 50 can be sealed, if desired. When the small passages 50 are thermally formed in the tube wall, a portion of the HDPE material can be thermally fused over the passage as a seal. The passive ballast tubes 48 act like a bulb keel on a boat to drive the center of gravity of the structural flotation device 10 lower relative to the waterline. The passive ballast tubes 48 thereby provide stability to the flotation device 10 in rough sea conditions.

When the ballast material 46 is to be water, the passive ballast tubes 48 are formed with at least two or more of the passages 50 that are left open. The passages 50 are positioned such that, when submersed in water during use, one of the passages operates as a fill hole for introduction of surrounding water into the interior of the tube, while another of the passages operates as a vent for air to escape. Alternatively, a single passage directed toward the top edge 20 of the shear panels 12, i.e., the deck 18, is positioned to operate as both a fill hole and air vent. Thus, while water may flow through the ballast tubes 48 as a result of tidal, thermal or other current action, at any time the ballast tubes 48 contain an amount of water that acts as passive ballast material.

According to another alternative embodiment of the invention, the passive ballast material 46 is introduced into the transverse tubes 14 through one or more alternative shear panel passages 52 formed in one or both of the shear panels 12 within the diameter of the passive ballast tubes 48. According to one embodiment, the passage or passages 52 are small passages (shown at center) in the shear panels 12 through which the ballast material 46 is introduced. When the ballast material is to be water drawn from the surrounding body of water, either one or more of the passages 52 is positioned to operate as a vent, or the shear panel passages 52 are combined with one or more of the wall passages 50 positioned to operates as a vent for air to escape the ballast tube 48, as discussed above.

Alternatively, the shear panel passage 52 is sized as large as the diameter of the tube 48. A single passage 52 may be provided, which results in a close-ended tube 48 for pouring a ballast material 46 such as concrete, grout. Optionally, passage 52 is later covered and sealed if desired. When the ballast material 46 is to be water introduced when the structural flotation device 10 is floated and the ballast tubes 48 submerged, the surrounding water flows into and fills the tube 48 from the ends.

When the ballast tubes 48 are to be completely open at one or both ends by the full-sized shear panel passages 52 (even if later covered and sealed), one or both of the passages 52 are alternatively provided by providing holes in the shear panels 12 sized to admit the full outside diameter of the tube 48. The tube 48 fits within the shear panel passages 52 and, optionally, extends outside the bounds of the two shear panels. In such configuration, if the passages 52 arc to be covered and sealed, an external cover 54 is applied as a disk of appropriately sized HDPE material either thermally fused to the tube 48, or joined by another conventional mechanical joining method, such as is generally well-known in the art. For example, the cover 54 is joined using an appropriate adhesive, or by bolts through a flange joined to the open ends of the tubes 48 and corresponding holes in the cover 54. The cover 54 is made water-tight by compressible o-rings captured between a flange on the tube 48 and the cover 54 and being compressed by nuts threaded onto bolts through the flange.

Multiple structural flotation devices 10 of the invention are optionally connected together side-to-side to form a large square or rectangular float. A rigid connection is provided between adjacent structural flotation devices 10 by means of bolts passed through the corresponding whalers 26. Optionally, the corresponding shear panels 12 of adjacent flotation devices 10 are thermally fused.

Multiple structural flotation devices 10 of the invention are optionally connected together end-to-end to form a long rigid pier. A rigid connection may be provided between, adjacent structural flotation devices 10 by means of steel plates secured by bolts and nuts between corresponding interior partitions 16.

Alternatively, multiple structural flotation devices 10 of the invention are connected together end-to-end with hinged joints to form a long flexible pier. For example, steel jam plates are attached to the interior partitions 16 using bolts and nuts. Adjacent structural flotation devices 10 are attached by steel hinge plates connected between the steel jam plates using a pair of hinge pins inserted like the hinge pins of a bicycle chain through holes in either end of the hinge plate and mating holes in the steel jam plates of each structural flotation devices 10. Alternatively, the steel hinge plates are used with hinge pin bushings inserted through the interior partitions 16. The hinge pins are inserted through holes in either end of the hinge plate and the mating hinge pin bushings.

Adjacent structural flotation devices 10 are connected to other structural flotation devices 10 to form a right angle or rigid tee connection by means of steel plates attached to the outside whaler 26 by bolts and nuts.

Structural flotation devices 10 are connected to piling by means of conventional fixed pile hoops or chain type connectors.

While the preferred embodiment of the invention has been illustrated and described, it will be appreciated that various changes can be made therein without departing from the spirit and scope of the invention.

What is claimed is:

1. A structural flotation device; comprising:

a pair of spaced apart elongated shear panels each formed of a substantially planar sheet of high-density polyethylene (HDPE);

a plurality of buoyancy tubes transversely oriented between the elongated shear panels, each of the buoyancy tubes being formed of HDPE pipe and being sized relatively shorter than the elongated shear panels; and a thermal fusion joint formed between each end of each of the buoyancy tubes and a surface of each of the elongated shear panels.

2. The structural flotation device of claim 1 wherein each of the structural joints formed between the buoyancy tubes and the elongated shear panels further comprises a substantially water-tight structural seam.

3. A structural flotation device, comprising:

a pair of spaced apart elongated shear panels each formed of a substantially planar sheet of high-density polyethylene (HDPE);

a plurality of buoyancy tubes transversely oriented between the elongated shear panels, each of the buoyancy tubes being formed of HDPE pipe and being sized relatively shorter than the elongated shear panels, one or more of the buoyancy tubes further comprising structure for containing an amount of ballast material within the buoyancy tube; and a structural joint formed between each end of each of the buoyancy tubes and a surface of each of the elongated shear panels.

4. A structural flotation device, comprising:

a pair of spaced apart elongated shear panels each formed of a substantially planar sheet of high-density polyethylene (HDPE);

a plurality of buoyancy tubes transversely oriented between the elongated shear panels, each of the buoyancy tubes being formed of HDPE pipe and being sized relatively shorter than the elongated shear panels;

a structural joint formed between each end of each of the buoyancy tubes and a surface of each of the elongated shear panels; and one or more elongated interior support panels each formed of HDPE material, each of the one or more elongated interior support panels being positioned between the elongated shear panels and structurally joined in crosswise orientation to the buoyancy tubes.

5. The structural flotation device of claim 4, further comprising one or more structural thermal fusion joint formed between each interior support panels and of each of the buoyancy tubes.

6. A structural flotation device, comprising:

a pair of spaced apart elongated shear panels each formed of a substantially planar sheet of high-density polyethylene (HDPE);

a plurality of buoyancy tubes transversely oriented between the elongated shear panels, each of the buoyancy tubes being formed of HDPE pipe and being sized relatively shorter than the elongated shear panels;

a structural joint formed between each end of each of the buoyancy tubes and a surface of each of the elongated shear panels; and one or more baffles structurally joined between the transversely oriented buoyancy tubes.

7. A structural flotation device, comprising:

a pair of elongated shear panels each formed of a substantially planar sheet of high-density polyethylene (HDPE), the elongated shear panels being spaced apart a transverse distance that is a fraction of a longitudinal dimension of the panels; and a row of buoyancy tubes each formed of HDPE pipe having a diameter that is relatively narrower than a width dimension of the elongated shear panels and a length that substantially fills the transverse distance between the elongated shear panels, the row of buoyancy tubes being spaced apart between the elongated shear panels with each of the buoyancy tubes being structurally joined by a thermal fusion joint in transverse orientation to an unbroken surface of each of the elongated shear panels.

8. The structural flotation device of claim 7 wherein a structural joint whereby each of the buoyancy tubes is structurally joined in transverse orientation to of each of the elongated shear panels further comprises a substantially water-tight joint.

9. The structural flotation device of claim 7, further comprising a plurality of spaced apart elongated interior support panels positioned between the elongated shear panels and being fused to one or more of the buoyancy tubes.

10. The structural flotation device of claim 7 further comprising one or more baffles structurally joined between the buoyancy tubes and the each of the elongated shear panels.

11. The structural flotation device of claim 10, further comprising an amount of supplemental flotation supported by one or more of the baffles.

12. The structural flotation device of claim 7, further comprising an amount of supplemental flotation contained by one or more of the buoyancy tubes.

13. The structural flotation device of claim 7, further comprising:

one or more additional rows of the buoyancy tubes formed of HDPE pipe, whereby a plurality of rows of buoyancy tubes are transversely oriented between the elongated shear panels; and one of the rows of buoyancy tubes being spaced further away than an other one of the rows of buoyancy tubes from a longitudinal edge of the elongated shear panels and being structurally joined in transverse orientation to each of the elongated shear panels.

14. The structural flotation device of claim 13, further comprising structure for containing an amount of ballast material within one or more of the buoyancy tubes.

15. The structural flotation device of claim 13, further comprising an amount of ballast material contained within one or more of the buoyancy tubes.

16. A structural floatation device, comprising:

a plurality of tubes of substantially identical length each formed of high-density polyethylene (HDPE) pipe, the tubes being arranged in a row of substantially parallel and spaced apart tubes;

two substantially planar sheets of HDPE material each being wider than a diameter of the HDPE tubes and substantially longer than the length of the HDPE tubes, the two HDPE sheets being substantially parallel and spaced apart by the row of HDPE tubes positioned therebetween with a respective unbroken surface of each of the HDPE sheets covering the entire diameter of the HDPE tubes and being joined thereto with a substantially rigid structural thermal fusion joint; and means for supporting decking above the HDPE tubes and HDPE sheets.

17. The structural flotation device of claim 16 wherein each of the HDPE sheets further comprises a portion thereof disposed between the HDPE tubes and a longitudinal edge of the HDPE sheet, whereby the HDPE tubes are space away from the longitudinal edge of the HDPE sheet.

18. The structural flotation device of claim 17, further comprising a plurality of spaced apart elongated interior support panels formed of substantially planar sheets of HDPE material, the elongated interior support panels being positioned between the HDPE sheets in crosswise orientation to the HDPE tubes and thermally fused thereto.

19. The structural flotation device of claim 18 wherein the plurality of spaced apart elongated interior support panels are further positioned in substantially parallel orientation with the HDPE sheets.

20. The structural flotation device of claim 18, further comprising a plurality of baffles structurally joined between the HDPE tubes and the HDPE sheets.

21. The structural flotation device of claim 20, further comprising supplemental flotation material coupled to one or more of the baffles.

22. The structural flotation device of claim 16, further comprising a second row of HDPE tubes offset from a longitudinal edge of the HDPE sheets relative to a first row of HDPE tubes, the second row of HDPE tubes containing a quantity of ballast material.

* * * * *